United States Patent [19]

Davis, Sr.

[11] Patent Number: 4,649,240

[45] Date of Patent: Mar. 10, 1987

[54] ELECTRIC TILT SWITCH WITH A LIQUID CONTACT CLOSER

[76] Inventor: Braxton E. Davis, Sr., 6243 S. Hermitage, Chicago, Ill. 60636

[21] Appl. No.: 754,488

[22] Filed: Jul. 12, 1985

Related U.S. Application Data

[63] Continuation-in-part of Ser. No. 288,540, Nov. 12, 1981, abandoned.

[51] Int. Cl.[4] ..... H01H 29/20; H01H 35/14

[52] U.S. Cl. ..... 200/61.47; 200/61.52; 200/215; 200/220; 200/223

[58] Field of Search ..... 260/182–236, 260/61.47, 61.52

[56] References Cited

U.S. PATENT DOCUMENTS

| | | | |
|---|---|---|---|
| 1,925,274 | 9/1933 | Norviel | 200/220 X |
| 1,937,137 | 11/1933 | Barclay | 200/207 X |
| 1,948,687 | 2/1934 | Swinne | 200/235 X |
| 2,716,169 | 8/1955 | Hanson | 200/61.47 |
| 3,818,437 | 6/1974 | Di Marco | 200/61.47 X |
| 3,973,095 | 8/1976 | Greene | 200/235 X |
| 4,138,600 | 2/1979 | Ozols | 200/61.47 |
| 4,333,094 | 6/1982 | Osborne | 200/61.47 X |

*Primary Examiner*—J. R. Scott

*Attorney, Agent, or Firm*—Millen & White

[57] ABSTRACT

An electrical tilt switch comprises a closed housing having an annular geometry and made of insulating material. In the closed housing thee is positioned a first annular electrode and at least a second annular electrode spaced from the first annular electrode. A pool of conducting liquid is disposed within the housing so as to immerse one electrode without immersing the other when the switch is in a horizontal position. Upon tilting the switch to a preselected angle, the pool of conducting liquid immerses two of the electrodes and therefore closes the switch.

7 Claims, 8 Drawing Figures

ELECTRIC TILT SWITCH WITH A LIQUID CONTACT CLOSER

RELATED INVENTIONS

This application is a continuation-in-part of U.S. patent application Ser. No. 288,540, filed Nov. 12, 1981 now abandoned.

BACKGROUND OF THE INVENTION

1. Field of the Invention

The instant invention relates to tilt switches. More particularly, the instant invention relates to tilt switches which close contacts within the switch with a liquid which conducts electric current.

2. Technical Considerations and Prior Art

There are numerous tilt switches now on the market which utilize a liquid which conducts electricity. Generally these switches are configured with a pair of spaced contacts disposed in an enclosure along with a quantity of conducting liquid, which liquid is usually mercury. The mercury is attracted by gravity to the bottom of the enclosure. When the enclosure is tilted, the mercury tends to remain at the bottom of the enclosure and flows to seek its lowest level. If the enclosure is tilted far enough so that the mercury fills the space between the contacts, the switch is closed so that current flows from one contact, through the mercury to the other contact. As is readily apparent from the following list of U.S. Patents, there are numerous configurations and uses for the afore-described type of switch:

| | |
|---|---|
| 2,745,091 | Leffler |
| 2,823,367 | Huron |
| 3,074,049 | Saliba et al |
| 3,204,233 | Olliff |
| 3,276,007 | White |
| 3,656,100 | Beltrami |
| 3,683,423 | Crapanzano |
| 3,699,485 | Lindermeyer |
| 3,710,371 | Whalen, et al |
| 3,753,175 | Gillette |
| 3,787,641 | Hughes |
| 3,921,128 | Snead |
| 4,221,278 | Ponzo |

Of the above-identified patents, perhaps U.S. Pat. No. 3,787,647 is the closest in concept to the instant invention in that this patent discloses a pair of circular electrodes or contacts which are closed by a globule of mercury. In this particular patent, however, the globule of mercury is initially displaced from both contacts. The globule of mercury has to roll in the conical channel 33 to the top edge of the conical channel in order to close contacts 27. With this switch, there must be considerable tilting before the contacts 27 can be closed. Moreover, there is the chance that the mercury globule will simply flatten so far that it will not have sufficient height to close the gap between the two electrodes 27. Accordingly, the switch of U.S. Pat. No. 3,787,647 is not entirely satisfactory for all purposes.

In view of the aforementioned considerations, there is a need for a switch which will detect tilting in any direction throughout 360 degrees of orientation while at the same time being configured so that it is responsive to very slight degrees of tilt if necessary. Moreover, there is a need for a tilt switch which is sufficiently flexible in its design to accomodate various degrees of tilt and various specific needs and considerations.

SUMMARY OF THE INVENTION

It is the object of the instant invention to provide a new and improved tilt switch utilizing a conductive liquid, wherein the tilt switch is sensitive to tilts in any direction and is easily configured to accomodate various degrees of tilt and various situations associated with "tilting".

Upon further study of the specification and appended claims, further objects and advantages of this invention will become apparent to those skilled in the art.

The instant invention contemplates an electrical tilt switch wherein a pair of annular contacts are disposed in spaced relation in an enclosure wherein the enclosure includes a quantity of conducting liquid. The quantity of conducting liquid fills the enclosure to a certain height and preferably immerses one of the annular contacts. Upon tilting the enclosure, at least one portion of the upper contact touches and becomes immersed in the conducting liquid thereby closing the switch so that current can flow from one contact, through the conducting liquid to the other contact.

In accordance one embodiment of the invention, only two annular contacts are used. Depending on which way the enclosure containing the circular contacts is positioned, one is able to close the contacts by either a relatively slight tilting of the enclosure or by a greater tilting of the enclosure utilizing the same enclosure.

In accordance with a second embodiment of the invention, a plurality of contacts are utilized so that a plurality of degrees of tilting may be detected.

By varying the spacing of the contacts with respect to the upper and lower surfaces of the enclosure and varying the liquid level in a specific enclosure, one is able to accomodate the invention to a variety of conditions and uses.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DESCRIPTION OF THE PREFERRED EMBODIMENTS

Figure 1:
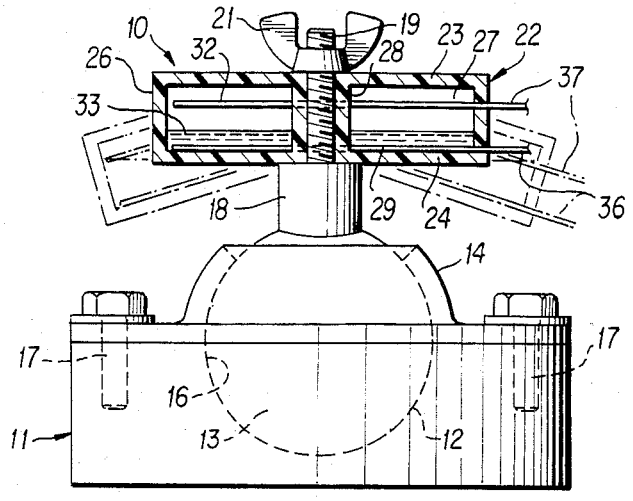
FIG. 1 is a side elevation of a first embodiment of the invention showing one annular contact positioned at the bottom of a liquid-containing enclosure and the other annular contact spaced from the top thereof.
Figure 8:
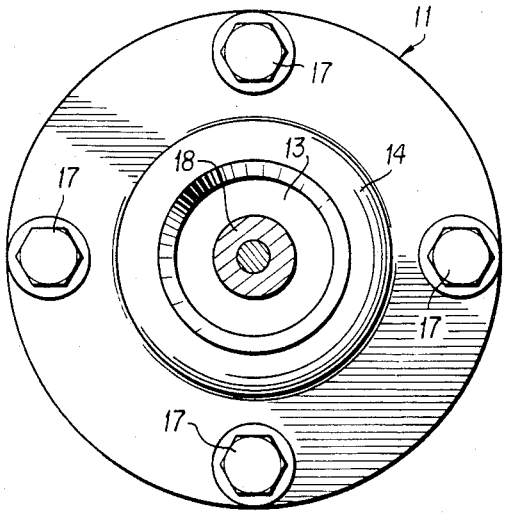
FIG. 8 is a bottom view of the support shown in FIG. 1.

Referring now to FIG. 1, wherein the first embodiment of the invention is shown, a tilt switch, designated generally by the numeral 10, is shown mounted on a base, designated generally by the numeral 11. The base 11 includes a spherical socket 12 which receives the lower half of a spherical knuckle 13. The spherical knuckle 13 is held in the socket 12 by a clamp member 14 which includes a spherical inner surface 16. The clamp member 14 is held in engagement with the base 11 by a plurality of screws 17 (also see FIG. 8). The spherical knuckle 13 has a stem 18 thereon which has a bolt portion 19 projecting upwardly therefrom. The bolt portion 19 has a wing nut 21 which may be screwed down thereupon.

The tilt switch 10 comprises a circular enclosure, designated generally by the numeral 22, which has an upper wall 23, a lower wall 24, and a circular peripheral wall 26 which joins the upper wall 23 and lower wall 24. The walls 23, 24 and 26 cooperate to define an enclosure 27 therein. The enclosure 27 is annular in that it receives therethrough a hollow journal 28 defining a bore 28'. The hollow journal 28 receives the bolt 19 through the bore 28' so as to mount the enclosure 22 on the bolt 19 and thus on the base 11.

Within the annular space 27 there is positioned a first electrode 29 which abuts both the second wall 24, which forms a lower wall in FIG. 1. Spaced from the first electrode by a distance 31 is a second electrode 32. As is seen in Example 1, the second electrode 32 is also spaced from the first wall or upper wall 23.

A pool of conducting fluid, preferably mercury is contained within the opening 27 of the enclosure 22 and covers the lower electrode 29. When the enclosure 22 is tilted by tilting the base 11, the pool of mercury 33 seeks its own lowest level. Gravity, causes the top surface of the pool of mercury 33 to remain horizontal while tilting of the enclosure 22 lowers the second electrode 31 so as to intersect the top surface of the mercury pool 33 thereby closing contact between the two annular electrodes 29 and 32 allowing current to flow between the electrodes. When this happens, what ever device (not shown) that is connected to the leads 36 and 37 of the electrodes 29 and 32, respectively, is operated. The device may, for example, be an alarm of some sort, such as a buzzer, or a light, or the device may be a cutoff switch which will stop operation of an engine or machine. There are numerous devices which can be operated by the switch arrangement shown in FIG. 1.

Figure 2:
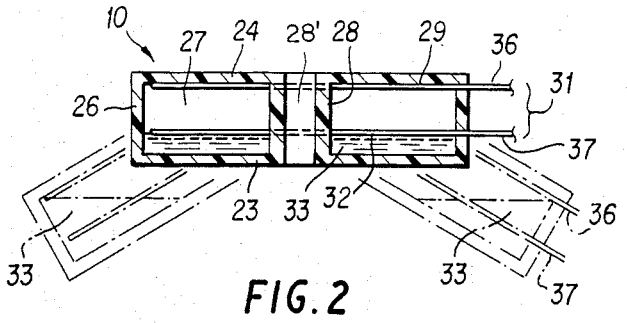
FIG. 2 is a view similar to FIG. 1 showing the enclosure of FIG. 1 turned upside down in order to provide a tilt switch arrangement which requires a greater degree of tilt than the arrangement of FIG. 1.

Referring now to FIG. 2, wherein similar reference numerals identify similar structure, the enclosure 22 of FIG. 1 has been turned upside down. By so doing, the angle at which the pool of mercury 33 closes the circuit with annular contacts 29 and 32 is changed. In the embodiment of FIG. 2, it is readily seen that the switch 10 must be tilted at a much greater angle than the switch of FIG. 1 in order to effect a closing of the switch. This is because the distance between the top of the pool of mercury and the first annular contact 29 has been increased since the pool of mercury remains at the same level with respect to the lower wall, which is now wall 23, and the upper wall, which is now wall 24. In essence, the liquid level remains the same while the distance between the annular contacts 29 and 32 has been increased. Consequently, the same switch 10 can have two rather drastically different outputs depending on how the enclosure 22 is oriented.

By utilizing annular contacts, the switch 10 may be activated upon being tilted in any direction throughout 360° of rotation and thus can take the place of utilizing an array of liquid contact switches, which has been necessary in the past to detect tilting in a variety of directions. The annular contacts 29 and 32 are continually exposed within the housing over their entire length. Accordingly, contact is available between the contacts 29 and 32 and conducting liquid, 33 throughout 360° or orientation.

Figure 4:
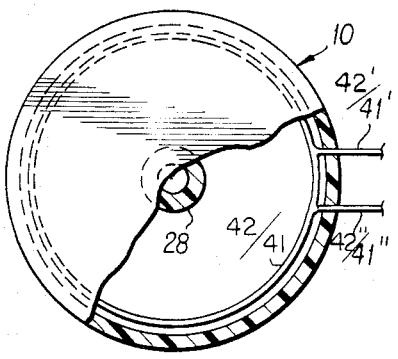
FIG. 4 is a top view of the embodiment of the invention shown in FIG. 3 wherein each electrode has more than one lead.
Figure 3:
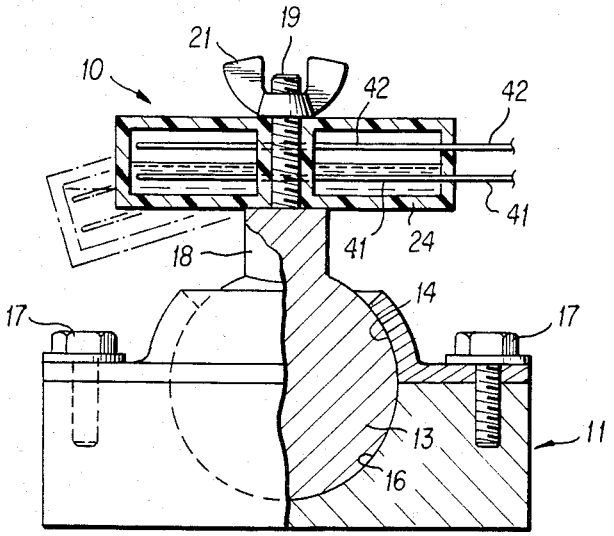
FIG. 3 is side view, partially in section showing a second embodiment of the invention wherein the electrodes are equally spaced from the wall and one another.
Figure 7:
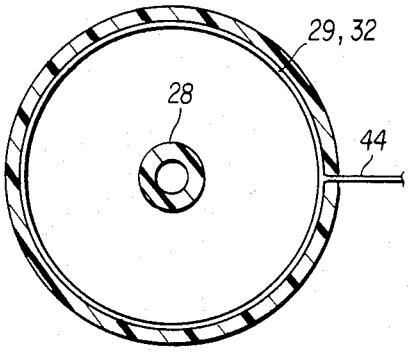
FIG. 7 is a sectional view of FIG. 1 showing an annular contact member having a single lead.

Referring now to FIG. 3 wherein a second embodiment of the invention is disclosed, and wherein similar reference numerals designate similar parts, electrodes 41 and 42 are shown. In the embodiment of FIG. 3, the electrodes 41 and 42 are equally spaced from the first and second walls 23 and 24. Consequently, it makes no different how one orients the enclosure 22. This is because the electrode 41 is the same distance from the first wall 23 as the electrode 42 is from the second wall 24. As is seen in FIG. 4 the annular contacts 41 and 42 each have a pair of leads 41'-41" and 42'-42" extending therefrom. Consequently, the tilt switch 10 may be used to operate in parallel more than one device such as a redundant alarm system, or perhaps an alarm system and a light. This arrangement is in comparison to that of FIG. 7 wherein each of the annular contacts has but a single lead 44. Any of the embodiments of the invention may utilize either the single lead of FIG. 7 or multiple leads of FIGS. 4 and 5.

Figure 5:
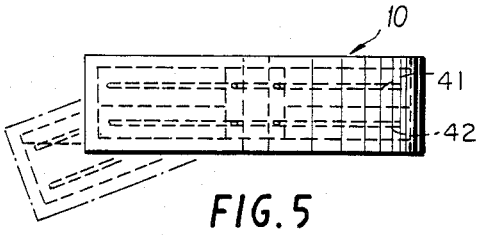
FIG. 5 is a side view of the embodiment of FIG. 4.
Figure 6:
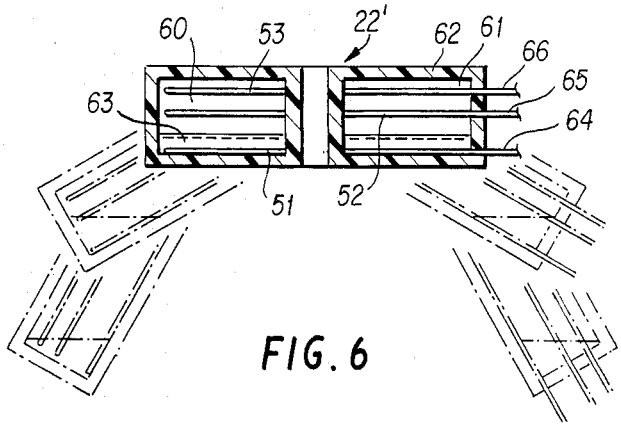
FIG. 6 is a side view of a third embodiment of the invention wherein more than two electrodes are used in a single enclosure in order to provide stepwise sensing of more than a single degree of tilt.

Referring now to FIG. 6, there is shown a third emobdiment of the invention wherein the enclosure 22' includes more than two annular contacts. In this embodiment, annular contacts 51, 52 and 53 are arranged in spaced vertical relation within an enclosure 61 of a housing 62. A pool of mercury 63 is at a first level when the enclosure 62 is horizontal so that there is no closure of contacts. Upon tilting the enclosure 62 to the first position shown in dotted lines, the pool 63 of mercury contacts annular contact members 51 and 52 closing the electrical path therebetween. However, the contact 53 is not closed. Consequently, it is possible to have an output signal on leads 64 and 65 connected to annular contacts 51 and 52 respectively without having an output on lead 66 which is connected to annular contact 53. Upon tilting the enclosure 62 further, the pool of mercury 63 closes the electrical path between annular contact 53 and annular contact 52 thus providing a closed contact signal on line 66. The arrangement of FIG. 5 is suitable for applications such as devices and machines wherein a warning signal is emitted if the machine tilts to a certain angle and perhaps a cutoff signal is emitted should the machine tilt to a second level. While the embodiment of FIG. 6 shows three contacts, it is within the scope of this invention to include as many contacts as are necessary. FIG. 6 demonstrates a stepwise arrangement for detecting a plurality of discrete angles of tilt wherein the discrete angles have some particular significance.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An electrical tilt switch comprising:

a closed housing in the form of an annular enclosure having spaced annular top and bottom planar walls and spaced inner and outer vertical walls wherein at least the inner surfaces of the walls are of a material which is electrically non-conducting the enclosure having a bore therethrough for receiving a mounting stem;

a first electrode in the housing wherein the first electrode is annular in configuration and has a lead extending therefrom to the exterior of the housing;

a second electrode, also annular in configuration positioned in the housing and spaced vertically from the first electrode, the second electrode having a lead extending therefrom, through the housing to the exterior of the housing;

a pool of conducting liquid within the housing, the pool of conducting liquid immersing the first electrode and providing continuous contact therewith, whereby when the housing is tilted the second electrode moves toward the pool of liquid and is engageable by the pool of liquid so as to electrically connect the first and second electrodes.

2. The tilt switch of claim 1 wherein the first electrode is in contact with one of the planar walls whereas the second electrode is spaced from the other plans wall whereby the switch has two modes of operation, the first mode being with the first electrode on the bottom and the second mode being with the switch turned upside down so that the second electrode is on the bottom.

3. The tilt switch of claim 1 wherein the electrodes are equally spaced from each wall in the vertical direction, whereby it is inconsequential which side is up.

4. The tilt switch of claim 1 further including at least one additional electrode spaced vertically from the second electrode wherein when the switch is tilted to a first position contact is established between the first and second electrodes and wherein when the switch is tilted to a third position contact is established between the first, second and third electrodes so as to establish multiple modes of operation with a single tilt switch.

5. The apparatus of claim 1 wherein, the mounting device includes a ball and a socket wherein the stem projects from the ball, and wherein the ball is received in the socket and can be readily adjustable with respect thereto.

6. The tilt switch claim 1 wherein there is more than one lead extending from each electrode.

7. The tilt switch of claim 1 where there is a single lead extending from each electrode.

* * * * *